US005386631A

United States Patent [19]

Van Asten et al.

[11] Patent Number: 5,386,631

[45] Date of Patent: Feb. 7, 1995

[54] SHAVING APPARATUS WITH A MOVABLE TRIMMER

[75] Inventors: Jan F. Van Asten, Wölfnitz, Austria; Francis Chu, Eindhoven, Netherlands; Ingo Müller, Klagenfurt, Austria

[73] Assignee: U.S. Philips Corporation, New York, N.Y.

[21] Appl. No.: 62,678

[22] Filed: May 17, 1993

[30] Foreign Application Priority Data

May 19, 1992 [AT] Austria ..... A 1025/92

[51] Int. Cl.[6] ..... B26B 19/02; B26B 19/38

[52] U.S. Cl. ..... 30/34.1

[58] Field of Search ..... 30/34.1, 43.92, 43.9, 30/45.6, 34.05

[56] References Cited

U.S. PATENT DOCUMENTS 4,845,847 7/1989 Yasunaka et al. ..... 30/34.1
4,926,551 5/1990 Wolfger ..... 30/43.92
5,052,106 10/1991 Labrijn ..... 30/34.1
5,105,541 4/1992 Messinger et al. ..... 30/34.1

FOREIGN PATENT DOCUMENTS 61-59155 12/1986 Japan .

*Primary Examiner*—Douglas D. Watts
*Attorney, Agent, or Firm*—Ernestine C. Bartlett

[57] ABSTRACT

A shaving apparatus (1), which has an inclined housing side wall (9) comprising a first wall portion (22) and a second wall portion (23) connected to the first wall portion (22) by a curved transitional wall portion (24), comprises a movable trimmer (8) at the location of the first wall portion (22) and an actuating element (59) for controlling the movement of the trimmer (8), which element is arranged in the area (25) of the second wall portion (23). The trimmer (8) comprises a cutter support (26) which is coupled to the actuating element (59) via a coupling device (61). The coupling device (61) is formed by a single flexible coupling member which extends over the transitional wall portion (42) of the inclined side wall (9) and which is adapted to the curvature of the transitional wall portion (24).

4 Claims, 3 Drawing Sheets

SHAVING APPARATUS WITH A MOVABLE TRIMMER

BACKGROUND OF THE INVENTION

The invention relates to a shaving apparatus having a housing with a head area, of which housing at least one side wall is inclined in its area adjoining the head area and comprises a first wall portion and a second wall portion, which wall portions subtend an obtuse angle and are interconnected by a transitional wall portion curved in accordance with the inclination of the side wall, having a shaving head which is mounted on the housing in the head area and which is inclined owing to the inclination of the side wall relative to the housing area which is remote from the head area, having a trimmer which is arranged at the location of the first wall portion and which is movable between at least two positions relative to the first wall portion, which trimmer comprises a cutter support carrying a first toothed cutter, which is stationary in operation, and a second toothed cutter, which can be driven to reciprocate in operation and is adapted to cooperate with said first toothed cutter, having an actuating element which can be actuated by hand and is arranged to be movable on the housing at the location of the second wall portion, the cutter support being moved upon the actuation of said actuating element, and having a coupling device arranged between the actuating element and the cutter support to control the movement of the cutter support by its movement upon actuation of the actuating element.

A shaving apparatus of the type defined in the opening paragraph is known, for example, from JP 61-59.155 B2. The known shaving apparatus comprises a pivotable trimmer which is movable between two pivoted positions upon actuation of an actuating element constructed as a slide knob. Its coupling device comprises a coupling slide which is connected to the slide knob and a two-arm coupling lever which can be controlled and moved by the coupling slide, which keeps one lever arm of the coupling lever in operative engagement with a coupling projection on the coupling slide under the influence of a leg spring of the coupling device, and which has a coupling pin which projects laterally from the other lever arm and engages a fork-like portion of the cutter support of the trimmer. Thus, all in all the coupling device is of a comparatively intricate construction comprising a plurality of parts, which is in conflict with the requirement to make the shaving apparatus as simple and as cheap as possible and to make the coupling device as reliable and as compact as possible.

SUMMARY OF THE INVENTION

It is an object of the invention to mitigate the above-mentioned problems with a shaving apparatus of the type defined in the opening paragraph, to achieve an as simple and as cheap as possible construction of such a shaving apparatus, and to produce a coupling device which is as simple, as compact and as reliable as possible. To achieve this the invention is characterised in that the coupling device is formed by a single flexible coupling member which extends over the transitional wall portion of the inclined side wall and which is adapted to the curvature of the transitional wall portion, which coupling member is connected both to the actuating element and to the cutter support. This results in a very simple, compact and reliable coupling device.

This is advantageous in view of a simple and cheap construction of such a shaving apparatus and in view of an optimum reliability of the coupling device. Moreover, this has the advantage of an optimum adaptation of the construction of the coupling device to the inclination of the inclined side wall. The flexible coupling member may be constituted, for example, by a blade-spring-like metal or plastics part. However, it is found to be particularly advantageous if the coupling member is of a shutter-type construction and comprises slats which are hingeably connected to one another, which extend transversely of the direction of movement of the coupling member, and which at the location of their two free ends engage in guide grooves in the housing. This is advantageous in order to obtain a coupling member of a construction which is as stable as possible in the direction of the slats and which is resistant to flexure.

The actuating element may be arranged, for example, on another side wall than the trimmer, for example on the side wall opposite the side wall relative to which the trimmer is movable. However, it is found to be particularly advantageous if the trimmer comprises a cutter support which is guided to be movable substantially parallel to the first wall portion, and the cutter support of the trimmer, the flexible coupling member and the actuating element are constructed as an integral plastics part. This is advantageous in view of a particularly simple construction.

DETAILED DESCRIPTION OF THE INVENTION

Figure 1:
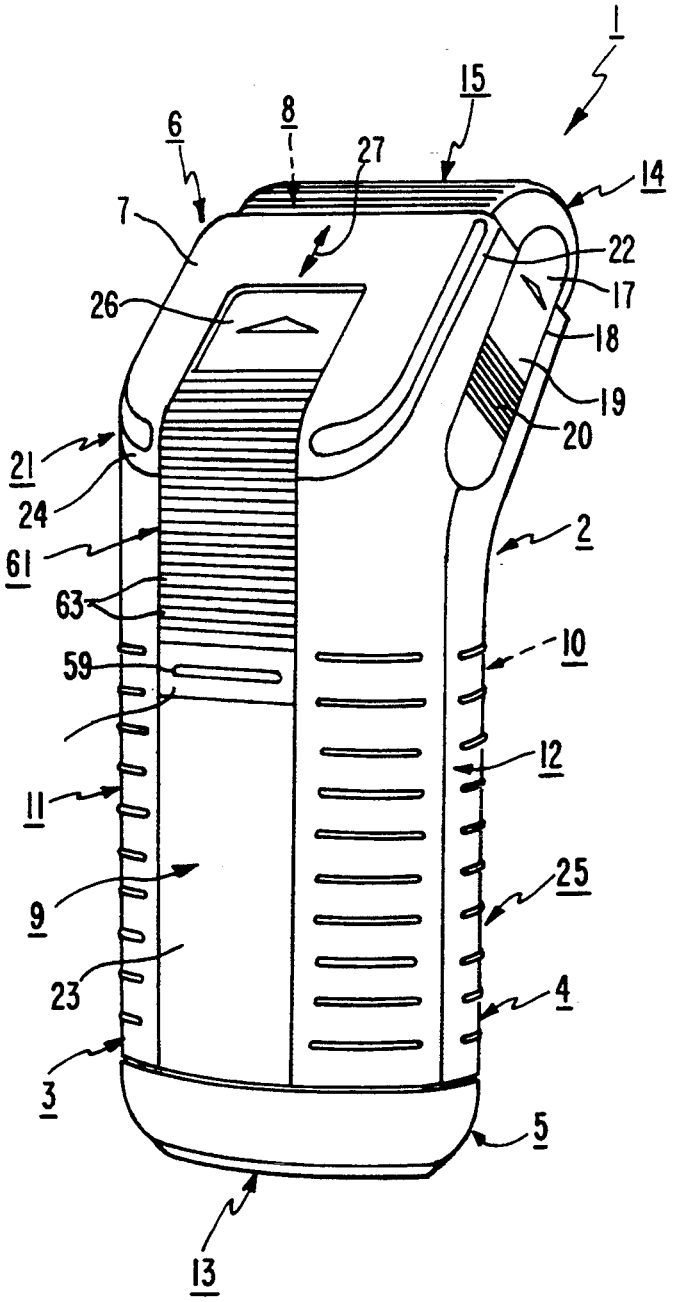
FIG. 1 is a substantially full-scale oblique view of a shaving apparatus in accordance with the invention, which apparatus comprises a movable trimmer and an actuating element, coupled to the trimmer via a coupling device, for the actuation of the trimmer, the coupling device being constituted by a shutter-type flexible coupling member.

FIG. 1 shows a shaving apparatus 1 whose housing 2 comprises a first housing section 3, a second housing section 4, and an end section 5, which holds the two housing sections 3 and 4 together at the bottom area, and a cover 7, which is snapped onto the first housing section 3 in the head area 6 of the two housing sections 3 and 4. The cover 7 serves for covering a trimmer 8, not shown in FIG. 1, which trimmer is movable between a rest position shown in FIGS. 1 and 3A and an operating position shown in FIG. 3B. The construction of the trimmer 8 is described in detail with reference to FIGS. 2 and 3. The housing 2 of the shaving apparatus 1 has a first broad side wall 9, a second broad side wall 10, a first narrow side wall 11, a second narrow side wall 12, which two narrow side walls 11 and 12 are divided by the separating zone separating the two housing sections 3 and 4, and a bottom wall 13, which is basically formed by the end section 4.

In its head area 6 the housing 2 carries a shaving head 14, which in known manner has an upper cutter in the form of a shear foil and a lower cutter cooperating with the shear foil, the two cutters not being shown in the Figures. To cover the shear foil the shaving apparatus 1 has a shutter 15 which is movable between a cover position, in which it covers the shear foil, and an open position, in which it exposes the shear foil. At its end which is remote from the shear foil the shutter 15 comprises an actuating element 16, shown in FIG. 3A, for its actuation.

When the shutter 15 has been moved to its open position the shaving head 14 can be removed from and placed onto the housing 2 of the shaving apparatus 1. In order to ensure that the shaving head 14 is positioned correctly relative to the housing 2 of the shaving apparatus 1 when this head 14 is placed onto the housing 2 the shaving head 14 has at each of its narrow end zones a guide portion 17, which engages a guide recess 18 between the two housing sections 3 and 4 when the shaving head 14 is placed onto the housing 2 of the apparatus 1 and which is positioned by the guide recess 18 when the shaving head 14 is mounted completely on the housing 2. At its end 19 which is remote from the shaving head 14 each of the two guide portions 17 adjoins a release button 20, which is movable substantially transversely of the narrow side walls 11 and 12 and upon whose actuation in a direction transverse to the narrow side walls 11 and 12 the shaving head 14 is unlatched, after which the shaving head 14 can be removed from the housing 2 of the shaving apparatus 1.

As is shown in FIG. 1, the first broad side wall 9 as well as the second broad side wall 10 of the housing 2 of the shaving apparatus 1 are both inclined in an area 21 adjoining the head area 6. The first broad side wall 9 has a first wall portion 22 terminating in the head area 6 and covered by the cover 7 of the housing 2. The first broad side wall 9 further has a second wall portion 23 terminating in the lower housing section. The first wall portion 22 and the second wall portion 23 of the first broad side wall 9 subtend an obtuse angle. The first wall portion 22 and the second wall portion 23 are interconnected by a transitional wall portion 24 curved in accordance with the inclination of the first broad side wall 9.

As a result of the inclination of the first broad side wall 9 and the second broad side wall 10 the shaving head 14 of the shaving apparatus 1 is inclined relative to the part 25 of the housing 2 which is remote from the head area 6. Such an inclined arrangement of the shaving head 14 is advantageous in order to obtain an easy to handle shaving apparatus 1, because in operation of the shaving apparatus 1 the housing 2 is held in the hand in such a way that the shaving head 14 is in an inclined position with respect to the face of the user of the shaving apparatus 1, which makes it very convenient to handle.

For an optimum ease of operation it is found to be effective if in its operating position the trimmer 8 is situated as close as possible to the shaving head 14, i.e. to the shear foil of the shaving head 14. In order to achieve this the trimmer 8 of the present shaving apparatus 1 is arranged at the location of the first wall portion 22 of the first broad side wall 9 of the housing 2 and is movable relative to the first wall portion 22 between the rest position shown in FIG. 3A and the operating position shown in FIG. 3B.

Figure 2:
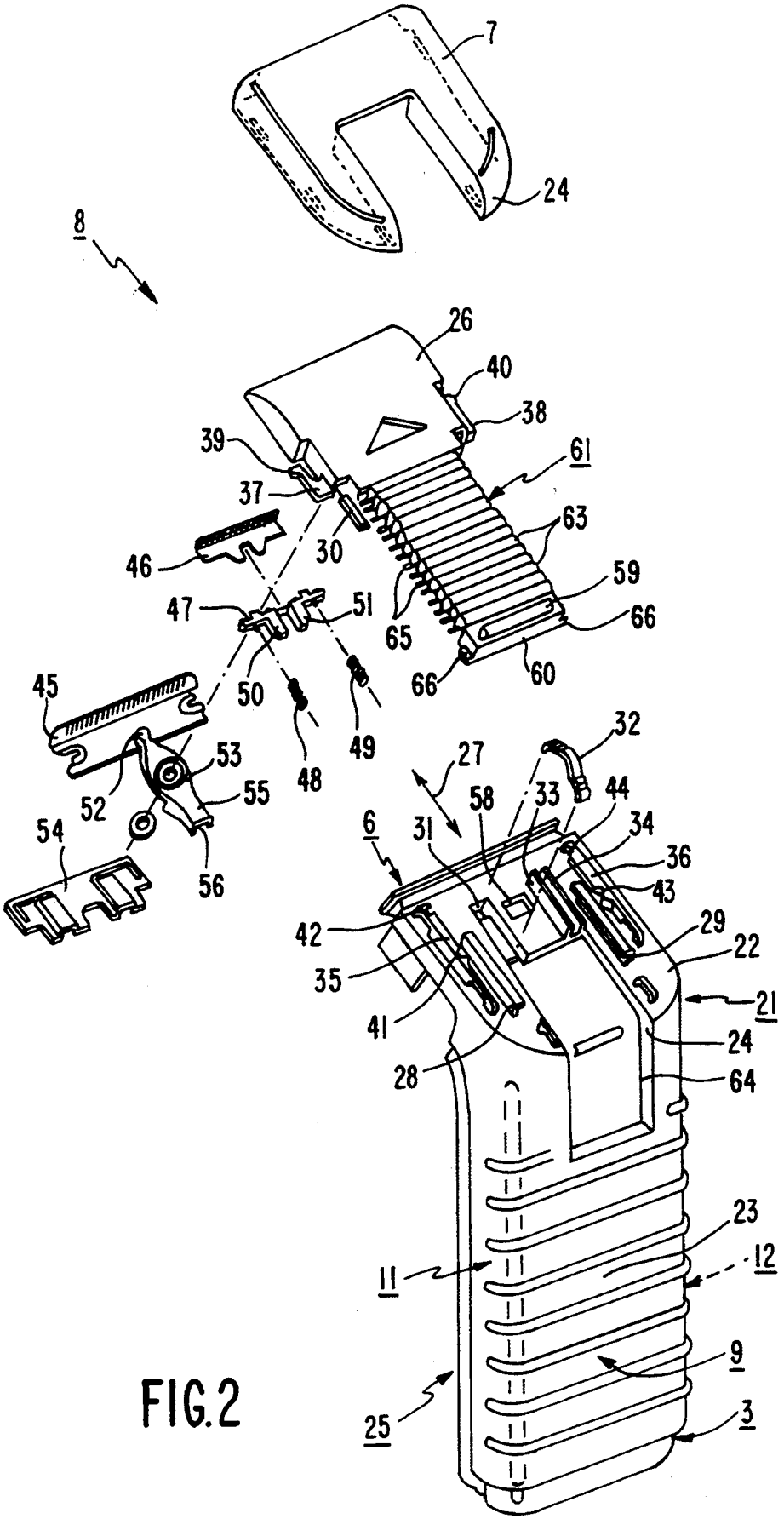
FIG. 2 shows, to a slightly smaller scale than FIG. 1, an exploded view of a housing half suitable for a shaving apparatus as shown in FIG. 1, and a trimmer arranged at the location of this housing half of the shaving apparatus.

As is apparent from FIGS. 2 and 3, the trimmer 8 comprises a cutter support 26 which is guided so as to be movable relative to the first wall portion 22 of the first broad side wall 9 of the first housing section 3 in the direction indicated by a double arrow 27. For guiding the cutter support 26 the first housing section 3 has two L-shaped guide members 28 and 29 projecting from its first wall portion 22, which guide members each cooperate with a simple guide member 30 projecting laterally from the cutter support 26, FIG. 2 showing only one guide member 30. A blade spring 32 is fitted in a recess 31 formed in the first wall portion 22 of the first housing section 3, the arcuate central portion of this spring pressing against the inner side of the cutter support 26, as a result of which the guide members 30 are urged against the angular portions of the L-shaped guide members 28 and 29, which thus keep the cutter support 26 positioned against the first wall portion 22. The blade spring 32 eliminates lost motion in a direction transverse to the first wall portion 22. For guiding the cutter support 26 in the direction indicated by the double arrow 27 there are provided two further guide members 33 and 34 which project perpendicularly from the first wall portion 22 and between which a guide pin engages, which pin projects from the inner side of the cutter support 26 and which is not shown in FIG. 2. The cutter support 26 is further guided by two guide members 35 and 36 which project perpendicularly from the first wall portion 22 and cooperate with two resilient guide arms 37 and 38 which project laterally from the cutter support 26. The free ends of the guide arms 37 and 38 are constructed as latching projections 39 and 40, which are engageable in respective latching recess 41, 42 and 43, 44, which respectively correspond to the rest position and the operating position of the trimmer 8. The guide arms 37 and 38 eliminate lost motion in a direction parallel to the first wall portion 22 and transverse to the actuating direction 27 of the cutter support 26.

Figures 3A, 3B:
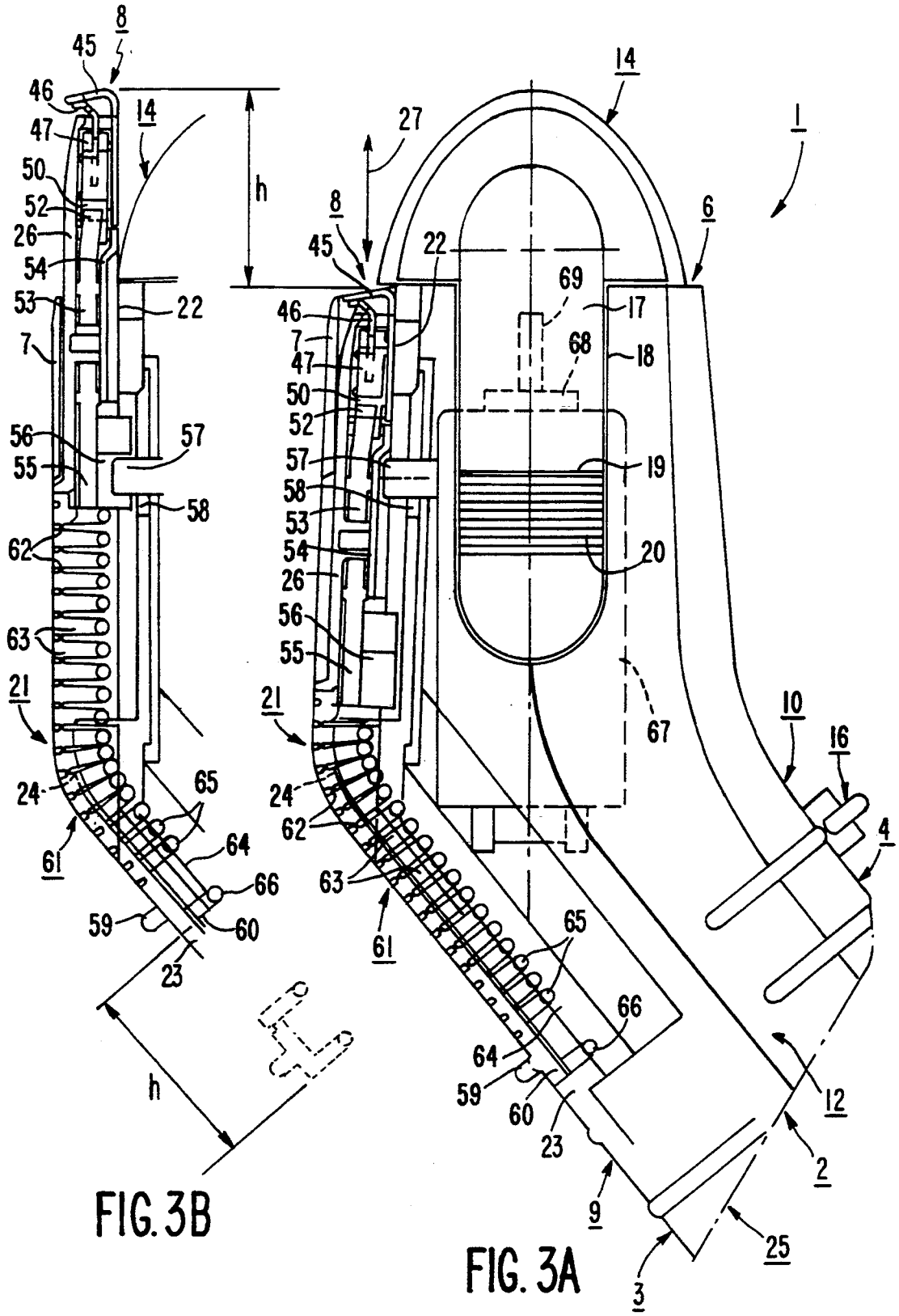
FIG. 3A is a partly sectional side view showing a part of the shaving apparatus of FIG. 1 to a slightly larger scale than FIGS. 1 and 2, part of the housing of the shaving apparatus being not shown in order to illustrate the trimmer of the shaving apparatus more clearly, the trimmer being shown in its rest position.
FIG. 3B in the same way as FIG. 3A shows only the trimmer of the shaving apparatus of FIGS. 1 and 2, the trimmer being shown in its operating position.

The cutter support 26 carries a first toothed cutter 45, which is stationary in operation, and a second toothed cutter 46, which is reciprocatingly drivable in operation and which cooperates with the first toothed cutter. The stationary first toothed cutter 45 is snapped onto the cutter support 26. The drivable second toothed cutter 46 is snapped onto a drive member 47, which is guided on the stationary first toothed cutter 45 so as to be movable in a reciprocating fashion, two pressure springs 48 and 49 acting on said drive member, the other ends of these springs beating against and being attached to the cutter support 26. The pressure springs 48 and 49 press the teeth of the drivable toothed cutter 46 against the teeth of the stationary toothed cutter 45 in order to ensure a satisfactory cutting performance. The drive member 47 has two limbs 50 and 51 which bound a gap in which the rounded end 52 of a driving lever 53 engages, which lever is pivotably supported on the cutter support 26. The driving lever 53 is secured to the cutter support 26 by means of a cover 54 connected to the cutter support. At its end 55 remote from the rounded end 52 the driving lever 53 has a drive slot 56 which, in the operating position of the trimmer 8, is engaged by a drive pin 57 for driving the driving lever 53, as is illustrated in FIG. 3B. The drive pin 57 passes through an opening 58 in a first wall portion 22 of the first broad side wall 9 of the first housing section 3.

For moving the cutter support 26 and hence the trimmer 8 in the directions indicated by the double arrow 27 the shaving apparatus 1 comprises an actuating element 59 which can be actuated by hand, which is movably arranged on the housing 2 at the location of the part 25 of the second wall portion 23 of the first broad side wall 9, and upon whose actuation the cutter support 26 is moved. In the present case the actuating element 59 is formed by a rib provided on a member 60 extending transversely of the actuating direction 27. Between the actuating element 59 and the cutter support 26 there is provided a coupling device 61 by means of which the movement of the cutter support can be controlled by its movement upon actuation of the actuating element 59.

In the present shaving apparatus 1 the coupling device 61 is formed in a very simple, compact, reliable and, consequently, advantageous manner by a single flexible coupling member which extends over the transitional wall portion 24 of the inclined first broad side wall 9 and which is curved in accordance with the transitional wall portion 24, which. coupling member is connected both to the actuating element 59 and to the cutter support 26. The coupling member 61 is of a shutter-type construction and comprises slats 63 which extend transversely of the actuating direction 27 of the coupling member 61 and have free ends which both engage in guide grooves 64 in the housing with guide pins 65 projecting laterally from the slats 63. Such guide pins also project laterally from the member 60 carrying the actuating element 59. The cutter support 26 of the trimmer 8, the flexible coupling member 61 and the actuating element 59 including the member 60 are formed as an integral plastics part, the hinges between the slats 63 being constructed as integral hinges.

The construction described above provides a particularly simple, compact and reliable coupling device, which is advantageous in order to achieve a simple and reliable construction of such a shaving apparatus and a reliable and compact construction of the coupling device. This also has the advantage that an optimum adaptation of the construction of the coupling device to the inclination of the side wall carrying the trimmer is achieved and that a minimal space is required. By constructing the coupling device as a shutter-type coupling member comprising slats which are hingeably connected to one another, which extend transversely of the actuating direction of the coupling member, and which are comparatively stiff transversely of the actuating direction, it also achieved that the coupling member has a comparatively high resistance to flexure. The integration of the cutter support, the coupling member and the actuating element results in a particularly simple construction.

With respect to FIG. 3 it is to be noted that FIG. 3A shows diagrammatically a motor support 67 which holds a motor 68 having a motor shaft 69. The motor shaft 69 can drive a drive means, not shown, comprising a reciprocating bridge and adapted to drive the cutter which cooperates with the shear foil of the shaving head 14. The drive pin 57, by means of which the driving lever 53 for the drivable cutter 46 of the trimmer 8 can be driven, projects laterally from the reciprocating bridge of said drive means.

As is apparent from FIG. 3A, there is no drive connection between the drive pin 57 and the driving lever 53 when the trimmer 8 is in its rest position. By actuation of the actuating element 59, i.e. by moving this element along the first broad side wall 9, the cutter Support 26 is moved in the direction indicated by the double arrow 27 and the entire trimmer 8 is moved into its operating position via the flexible coupling member 61, which is then moved over the curved transitional wall portion 24. the hinged slats 63 then being tilted about the integral hinges 62. Both the actuating element 59 and the trimmer 8 are then moved over a distance h, which in practice may be, for example, 16 mm. After such a movement of the trimmer 8 the drive pin 57 is coupled to the driving lever 53 to drive the drivable cutter 46 of the trimmer 8 when the motor 68 is switched on.

The invention is not limited to the exemplary embodiment described hereinbefore. For example, the actuating element for actuating the trimmer may be formed directly by one or more slats of the coupling member. Instead of a shutter-type coupling member having hingeably interconnected slats it is possible to use a coupling member constructed as a blade-spring-like metal or plastics part. The trimmer may be guided not only to be movable parallel to the first wall portion of the inclined side wall but also to be pivotable relative to this first wall portion, or the trimmer may be arranged to be merely pivotable relative to the first wall portion. Alternatively, the trimmer may be movable from a rest position into two different operating positions. The actuating element for the trimmer need not be arranged at the location of the side wall where the trimmer is situated. This actuating element may, for example, also be arranged at the location of the opposite broad side wall, where in the present shaving apparatus the actuating element for moving the shutter covering the shear foil is arranged, or also at the location of one of the two narrow side walls of the housing of the shaving apparatus.

We claim:

1. A shaving apparatus having a housing surrounding a head area and a remote area, said head area having a longitudinal axis extending to said remote area and said head area being inclined away from said remote area in a direction approximately of said axis, said housing comprising side walls bounding said head area and said remote area, at least one of said side walls, in its area adjoining said head area being inclined away from said remote area in said direction approximately of said axis, said at least one side wall comprising a first wall portion and a second wall portion, said wall portions subtending an obtuse angle and being interconnected by a transitional wall portion curved in accordance with the inclination of said side wall and having a shaving head mounted in the housing surrounding said head area, said shaving head being inclined in accordance with said side wall, having a trimmer which is arranged at the location of said first wall portion and which trimmer is movable between at least two positions relative to said first wall portion, said trimmer comprising a cutter support carrying a first toothed cutter, said first toothed cutter being stationary in operation, and a second toothed cutter, said second toothed cutter being driven to reciprocate in operation and adapted to cooperate with said first toothed cutter, having an actuating element arranged to be movable on the housing at the location of said second wall portion, said cutter support being moved upon the actuation of said actuating element, and having a coupling device movably arranged between said actuating element and said cutter support, said coupling device controlling the movement of said cutter support by its movement upon actuation of said actuating member, characterized in that said coupling device is formed at a single flexible coupling member, said coupling member extending over said transitional wall portion of said inclined side wall, adapted to the curvature of said transitional wall portion and movably connected to said transitional wall portion and said coupling member being connected to said actuating element and to said cutter support.

2. A shaving apparatus as claimed in claim 1, characterised in that the coupling member is of a shutter-type construction and comprises slats which are hingeably connected to one another, which extend transversely of the direction of movement of the coupling member, and which at the location of their two free ends engage in guide grooves in the housing.

3. A shaving apparatus as claimed in claim 1, characterised in that the trimmer comprises a cutter support which is guided to be movable substantially parallel to the first wall portion, and the cutter support of the trimmer, the flexible coupling member and the actuating element are constructed as an integral plastics part.

4. A shaving member as claimed in claim 2 wherein the trimmer comprises a cutter support which is guided to be movable substantially parallel to the first wall portion, and the cutter support of the trimmer, the flexible coupling member and the actuating element are constructed as an integral plastics part.

* * * * *